US009917666B2

(12) United States Patent
Gimenez Gandia et al.

(10) Patent No.: US 9,917,666 B2
(45) Date of Patent: Mar. 13, 2018

(54) METHOD AND DEVICE FOR RECEIVING A BROADCAST SERVICE COMPRISING SWITCHING BETWEEN DIGITAL AUDIO BROADCASTING (DAB) TRANSMISSIONS AND ENHANCED MULTIMEDIA BROADCAST/MULTICAST TRANSMISSIONS (EMBMS)

(71) Applicant: Bayerische Motoren Werke Aktiengesellschaft, Munich (DE)

(72) Inventors: Jordi Joan Gimenez Gandia, Alcoy (ES); Daniel Calabuig Soler, Valencia (ES); Jordi Calabuig Gaspar, Valencia (ES); Jose Francisco Monserrat Del Rio, Valencia (ES); David Gozalvez Serrano, Munich (DE); Oliver Klemp, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/438,187

(22) Filed: Feb. 21, 2017

(65) Prior Publication Data

US 2017/0163362 A1 Jun. 8, 2017

Related U.S. Application Data

(63) Continuation of application No. PCT/EP2014/074137, filed on Nov. 10, 2014.

(51) Int. Cl.
*H04H 20/26* (2008.01)
*H04H 20/62* (2008.01)
*H04H 20/18* (2008.01)

(52) U.S. Cl.
CPC ..... *H04H 20/26* (2013.01); *H04H 20/18* (2013.01); *H04H 20/62* (2013.01)

(58) Field of Classification Search
CPC ..... H04H 20/26; H04H 60/91; H04H 20/18; H04H 20/62; H04H 60/85; H04H 20/61; H04H 20/72
(Continued)

(56) References Cited

U.S. PATENT DOCUMENTS 6,804,510 B1 10/2004 Bates et al.
2005/0153650 A1 7/2005 Hikomoto
(Continued)

FOREIGN PATENT DOCUMENTS

DE 10 2013 215 728 A1 10/2014
EP 0 863 632 A2 9/1998
(Continued)

OTHER PUBLICATIONS

Written Opinion (PCT/ISA/237) issued in PCT Application No. PCT/EP2014/074137 dated Mar. 5, 2015 (Six (6) pages).
(Continued)

*Primary Examiner* — Keith Ferguson
(74) *Attorney, Agent, or Firm* — Crowell & Moring LLP

(57) ABSTRACT

A method for broadcast service following for a vehicle includes a first step of continuously, or in given time intervals, estimating a signal quality and/or signal availability of the DAB service and/or the cellular network based broadcast service in a route section the vehicle is expected to reach in a given time span. The method also includes a second step of performing a handover from the DAB service to the corresponding cellular network based broadcast service dependent on the estimated signal quality and/or signal availability. The first step may depend on provided data base information. The first step may in addition, or in the alternative, depend on service information, which is included in a received DAB signal.

12 Claims, 5 Drawing Sheets

(58) Field of Classification Search
USPC ..... 455/3.01–3.06, 422.1, 403, 414.1–414.4, 455/432.1–432.2, 436–444, 445, 550.1, 455/509, 450, 507, 508, 561, 426.1, 455/426.2, 513, 67.11, 500, 517; 370/310, 328, 329, 332, 331
See application file for complete search history.

(56) References Cited

U.S. PATENT DOCUMENTS

| | | | | |
|---|---|---|---|---|
| 2008/0225799 | A1* | 9/2008 | Lee | H04H 20/26 370/332 |
| 2016/0014793 | A1 | 1/2016 | Klemp et al. | |

FOREIGN PATENT DOCUMENTS

| | | | |
|---|---|---|---|
| EP | 1 139 065 | A2 | 10/2001 |
| WO | WO 99/14874 | A1 | 3/1999 |
| WO | WO 2009/083635 | A1 | 7/2009 |

OTHER PUBLICATIONS

International Search Report (PCT/ISA/220 & PCT/ISA/210) issued in PCT Application No. PCT/EP2014/074137 dated Mar. 5, 2015 (Four (4) pages).

* cited by examiner

S15

METHOD AND DEVICE FOR RECEIVING A BROADCAST SERVICE COMPRISING SWITCHING BETWEEN DIGITAL AUDIO BROADCASTING (DAB) TRANSMISSIONS AND ENHANCED MULTIMEDIA BROADCAST/MULTICAST TRANSMISSIONS (EMBMS)

CROSS REFERENCE TO RELATED APPLICATION

This application is a continuation of PCT International Application No. PCT/EP2014/074137, filed Nov. 10, 2014, the entire disclosure of which is herein expressly incorporated by reference.

BACKGROUND AND SUMMARY OF THE INVENTION

Embodiments of the invention relate to methods and corresponding apparatus for broadcast service following for a vehicle. The apparatus is arranged in the vehicle. The embodiments also relate to a computer program and a computer program product for broadcast service following for a vehicle.

In addition to pure broadcast systems such as Digital Audio Broadcasting (DAB), Frequency Modulation Broadcasting (FM), Amplitude Modulation Broadcasting (AM) and Digital Radio Mondiale Broadcasting (DRM), radio services can also be provided by means of cellular network communications systems like a Long Term Evolution system (LIE system) according to the wireless communication standard 3GPP Long Term Evolution, by using either typical unicast (one-to-one) transmissions or broadcast (one-to-many) transmissions with Enhanced Multimedia Broadcast Multicast Services (eMBMS).

Service following is a term used to define maintenance of the same audio or video content the user is experiencing when switching between different frequencies and/or transmission systems. Switching between different frequencies and/or transmission systems may be necessary when moving across different service areas in a Multi-Frequency-Network (MFN) or to cope with varying reception conditions that occur when e.g. travelling by car or between buildings inside a city.

WO 99/14874 discloses a method for test receiving alternative frequencies without interrupting the reception of DAB frames from the current reception frequency in a DAB receiver. The receiver scans the alternative frequencies carrying the same service content during null symbol periods of a DAB frame. The method allows a coarse synchronization to the alternative DAB frequency in order to allow for a frequency switch without noticeable interruption. This system and method requires an existence of a DAB system and a sufficient DAB coverage carrying the alternative frequencies.

DE 10 2013 215 728 A1 discloses the selection of a radio transmission channel from a group of radio transmission channels, each corresponding to different transmission technologies and I or use different infrastructure components and is produced via a data connection between a mobile unit and a central unit. The mobile unit comprises at least two radio units each formed for a data transmission via one of two radio transmission channels. For the selection of the radio transmission channel from the group of radio communication channels data of at least one earlier transmission link, so-called historical data, of at least one of the radio transmission channels are used.

The objects of the invention include providing methods and corresponding apparatus for broadcast service following for a vehicle which contribute to an improved service following between broadcast transmission systems, in particular in case of vehicle reception, which contributes to an improved user experience.

This and other objects are achieved by a method and a corresponding apparatus for broadcast service following for a vehicle. The vehicle is configured to receive signals of a Digital Audio Broadcast, DAB, system and at least of one cellular network based broadcast system.

For an anticipated service following from a given DAB service to a corresponding cellular network based broadcast service, continuously or in given time intervals a signal quality and/or signal availability of the DAB service and/or the cellular network based broadcast service in a route section the vehicle is expected to reach in a given time span is estimated dependent on a provided data base information including data representative for geographical locations of coverage gaps of the DAB service and/or geographical locations of coverage gaps of the cellular network based broadcast service and/or transition zones of the DAB service and the cellular network based broadcast service. Additionally or alternatively the signal quality and/or signal availability of the DAB service and/or the cellular network based broadcast service in the route section the vehicle is expected to reach in the given time span is estimated dependent on a service information that is included in a received DAB signal. The service information comprises data representative for geographical locations of coverage gaps of the DAB service and/or geographical locations of coverage gaps of the cellular network based broadcast service and/or transition zones of the DAB service and the cellular network based broadcast service. A handover from the DAB service to the corresponding cellular network based broadcast service is performed dependent on the estimated signal quality and/or signal availability.

The complementary use of cellular networks, by means of cellular network based broadcast transmission technology, to cover the coverage gaps of DAB networks improves user experience by removing the service interruptions caused by the lack of DAB coverage. In particular, the assistance with service information, and/or the data base information simplifies the switching procedure, thus reducing latency, and enables a seamless user experience. Moreover, the required service information can be introduced in the DAB service signal without any modification of the current standard, thus being backwards compatible with legacy DAB networks and systems.

The service information may comprise DAB service coverage information. The service information may be included in DAB transmission frames. Thus, the service information is available at every point in the coverage area of DAB services, i.e. before the need of switching to the cellular network based broadcast system arises and even before reaching the coverage zone of the cellular network based broadcast service. Thus, the vehicle is able to arrange for a switching procedure beforehand, allowing for some anticipation in the service following.

The given time span for anticipating the service following may be configurable.

According to one embodiment of the first and second aspect, continuously or in given time intervals the signal quality and/or the signal availability of the DAB service and/or the cellular network based broadcast service in the route section the vehicle is expected to reach in the given time span is estimated dependent on provided measurement data of a current digital audio broadcast service signal respectively a current cellular network based broadcast service signal received by the vehicle. Advantageously this allows for incorporating additionally actual circumstances in a surrounding area of the vehicle into the decision of whether a handover is required or not.

According to a further embodiment of the first and second aspect, the cellular network based broadcast service comprises an Enhanced Multimedia Broadcast Multicast Service (eMBMS). The use of eMBMS allows for a higher degree of efficiency for the simultaneous distribution of live audio content to a large number of users compared to cellular unicast transmissions.

According to a further embodiment of the first and second aspect, the handover is performed dependent on a current geoposition of the vehicle and/or an expected route of the vehicle and/or a velocity of the vehicle. Using the information of the current geoposition of the vehicle and/or the expected route of the vehicle and/or the velocity of the vehicle, the handover can be started further in advance. This facilitates synchronization of the two systems. The current geo-position of the vehicle and/or the expected route of the vehicle and/or the velocity of the vehicle may be provided by a vehicle navigation system and/or other suitable vehicle sensors.

According to a further embodiment of the first and second aspect, in the event that the handover is performed, the cellular network based broadcast service, which corresponds to the DAB service, is determined dependent on a DAB service ID information carried within user service descriptors contained in a cellular network based broadcast service signal. This allows for switching easily from the DAB service to the corresponding cellular network based broadcast service.

According to a further embodiment of the first and second aspect, the service information included in the DAB signal of the received DAB service comprises or represents the user service descriptors of the cellular network based broadcast service. In this way the service information may be completely transparent to existing DAB receivers, but new DAB receivers may be able to read and treat the information carried in specific fields of the DAB transmission frame. The service information may be included in Frequency Information, FI, list fields. There exist some free Range and Modulation, R&M, values expected for future use. One of these free R&M values may be used to broadcast some useful information for the management of the switching procedure from the DAB service to the corresponding cellular network based broadcast service. According to a further embodiment of the first and second aspect, the user service descriptors of the cellular network based broadcast service corresponding to the respective DAB service are retrieved from a given data base. The data base may be accessed remotely and/or locally stored and updated to anticipate the switching procedure.

According to a further embodiment of the first and second aspect, the DAB service ID information of the respective DAB services is included in a Multimedia Broadcast Multicast Service User Service Description, such that a DAB service identifier, which identifies the DAB service, is included in the form of a Uniform Resource Name, URN, which is carried in the Enhanced Multimedia Broadcast Multicast Service system (eMBMS system), and all or nearly all user service bundles from the eMBMS system are collected and are searched iteratively for the DAB service identifier to find the corresponding cellular network based broadcast service. This, in the case that no further information from the data base or from the DAB signaling is available, allows for determining the user service descriptors of the corresponding cellular network based broadcast service.

According to a further embodiment of the first and second aspect, a synchronization between the DAB service and the cellular network based broadcast service is performed by buffering an audio content of the DAB service and/or the cellular network based broadcast service dependent on a given delay between the DAB service and the cellular network based broadcast service, wherein the delay is provided by the data base and/or the service information included in the received DAB signal. The synchronization allows for coping with existing delays between the DAB service and the cellular network based broadcast service and may ensure a seamless service following operation. For these purposes, for instance, a suitable receiver device may buffer the audio content by slowing down the reproduction or repeating the last seconds of the service. The cellular network based broadcast service delay with respect to the DAB may be made available in the data base and/or in the service information included in the received DAB signal.

According to a further embodiment of the first and second aspect, geopositions where the service following has been completed successfully are stored in the data base and/or another data base to be usable as the data base information.

This allows for complementing the list of service shadowing regions and, as the data base information is provided in a backend, may contribute to improved service following applications in alternative vehicles of, for example, an Original Equipment Manufacturer vehicle fleet.

Additionally, the vehicle may be configured to receive signals of a Digital Audio Broadcast, DAB, system and at least of one cellular network based broadcast system. For an anticipated service following from a given cellular network based broadcast service to a corresponding DAB service, continuously or in given time intervals a signal quality and/or signal availability of the corresponding DAB service and/or the cellular network based broadcast service in a route section the vehicle is expected to reach in a given time span is estimated dependent on a provided data base information including data representative for geographical locations of coverage gaps of the DAB service and/or geographical locations of coverage gaps of the cellular network based broadcast service and/or transition zones of the DAB service and the cellular network based broadcast service. A handover from the cellular network based broadcast service to the corresponding DAB service is performed dependent on the estimated signal quality and/or signal availability.

This allows for deciding at an early stage whether a handover to the DAB service is required or possible.

Additionally, the computer program may be designed to execute the method for broadcast service following for a vehicle according to the first or third aspect or to an advantageous embodiment of the methods by its execution on a data processing device.

Additionally, a computer program product may include executable program code, wherein the program code executes the method for broadcast service following for a vehicle according to the first or third aspect or to an advantageous embodiment of the methods by its execution on a data processing device.

The computer program product comprises, in particular, a means which is readable by the data processing device and on which the program code is stored.

Other objects, advantages and novel features of the embodiments of the present invention will become apparent from the following detailed description of one or more preferred embodiments when considered in conjunction with the accompanying drawings.

DETAILED DESCRIPTION OF THE DRAWINGS

Figure 1:
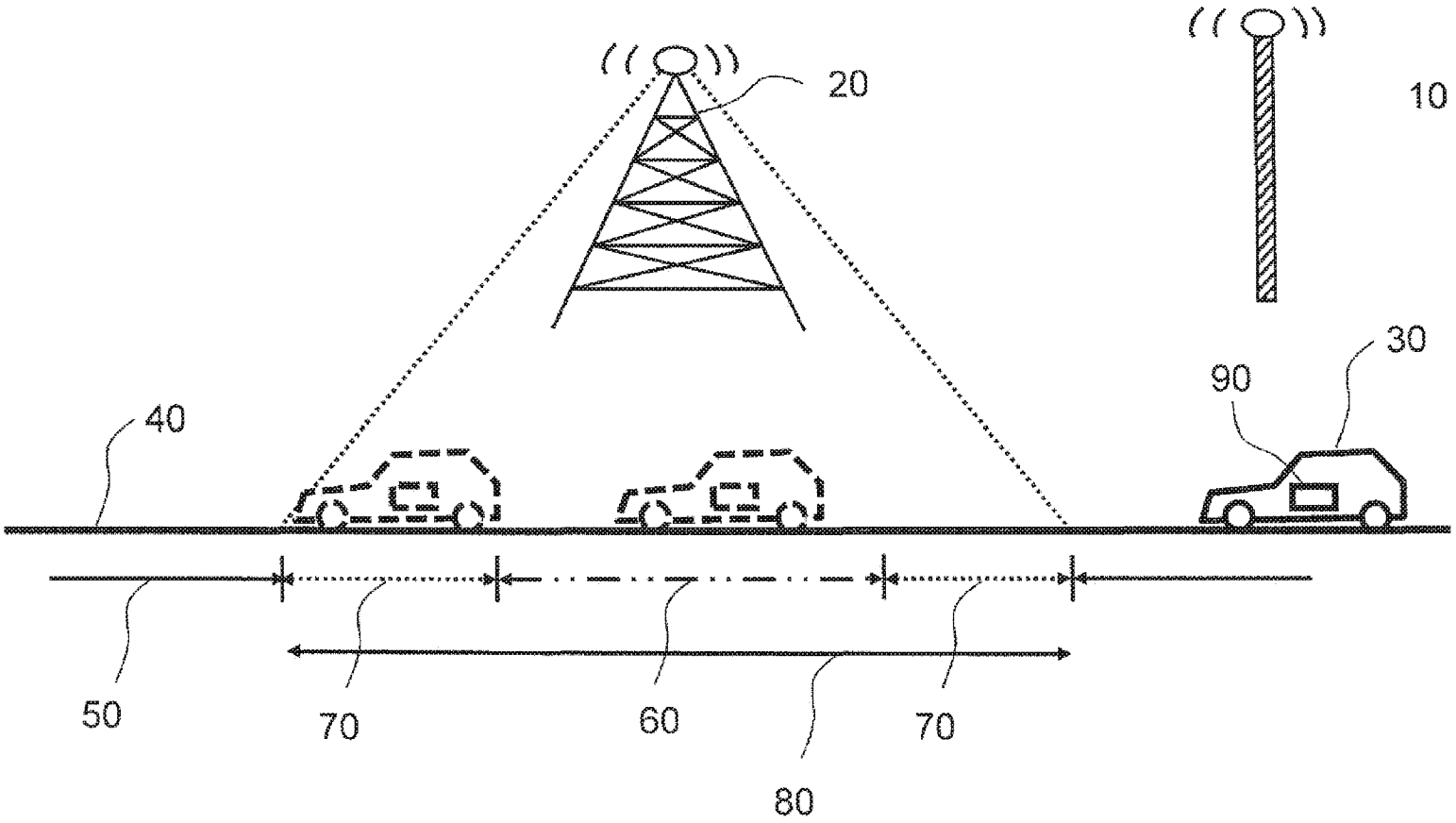
FIG. 1 a schematic block diagram depicting an application scenario of service following, FIG. 2 a flow chart of a program for broadcast service following for a vehicle, FIG. 3 a flow chart of a first sub-program, FIG. 4 a flow chart of a second sub-program, and FIG. 5 a flow chart of a third sub-program

FIG. 1 shows a schematic block diagram depicting an application scenario of service following. FIG. 1 shows a Digital Audio Broadcast (DAB) broadcasting tower 10, a base station 20 of a cellular network, in particular an Evolved Node B of an LIE network supporting Enhanced Multimedia Broadcast Multicast Services (eMBMS) and a vehicle 30 traveling on a road 40. As can be seen from FIG. 1 the road 40 passes partly DAB service coverage zones 50, partly cellular network based broadcast service coverage zones 80, partly DAB service coverage gaps 60 and partly transition zones 70, where both a DAB service coverage and a cellular network based broadcast service coverage is available. Preferably all or most of the services transmitted in the DAB are also available in the cellular network based broadcast.

In this scenario, the vehicle 30 travels within a DAB service area and has to go through the DAB service coverage gap 60 (DAB shadow) in which a cellular network based broadcast service coverage, preferably an eMBMS coverage, exists. As can be seen in FIG. 1, there are transition zones 70 surrounding the DAB shadow.

The use of broadcast transmissions, in particular eMBMS, is preferred in this context over cellular unicast transmissions due to the higher degree of efficiency that is achieved for the simultaneous distribution of live audio content to a large number of users.

According to the eMBMS standard, new elements are introduced into the LIE network to support eMBMS transmissions: a Broadcast Multicast Service Center (BM-SC), an MBMS Gateway (MBMS GW) and a Multicell Coordination Entity (MCE). The former, which was defined in MBMS Release 6, is the entry point for MBMS contents as it is located between a core network and a content provider. It controls start and end of MBMS transmissions, service announcements, security, and billing tasks among others. The main function of the MBMS GW is to forward the MBMS packets to Evolved Nodes B, eNBs, involved in the MBMS transmission using IP Multicast. Finally, the MCE performs a management of both MBMS contents and resources.

In MBMS terminology, an MBMS User Service is the entity in charge of providing the service to the end user and controlling its activation and deactivation. In general, an MBMS User Service can contain multiple distinct multimedia objects or streams, which may need to be provided over several MBMS download or MBMS streaming sessions. In case of a digital audio service, the MBMS User Service associated with it may be provided over an MBMS streaming session. Each session is associated with either a unicast bearer service or one or more MBMS bearer services and a set of delivery method parameters specifying how content is to be received on the mobile side. All MBMS Bearer Services of the same MBMS User Service are identified by the same Temporary Mobile Group Identity (TMGI).

The vehicle 30 comprises a receiving device 90. The receiving device 90 may also be called apparatus for broadcast service following.

The receiving device 90 is configured to execute a program for broadcast service following as explained in the following.

Preferably the receiving device 90 is also configured to receive signals of a Digital Audio Broadcast system and/or at least of one cellular network based broadcast system. In this way, additional devices and signal transmissions can be avoided.

Figure 2:
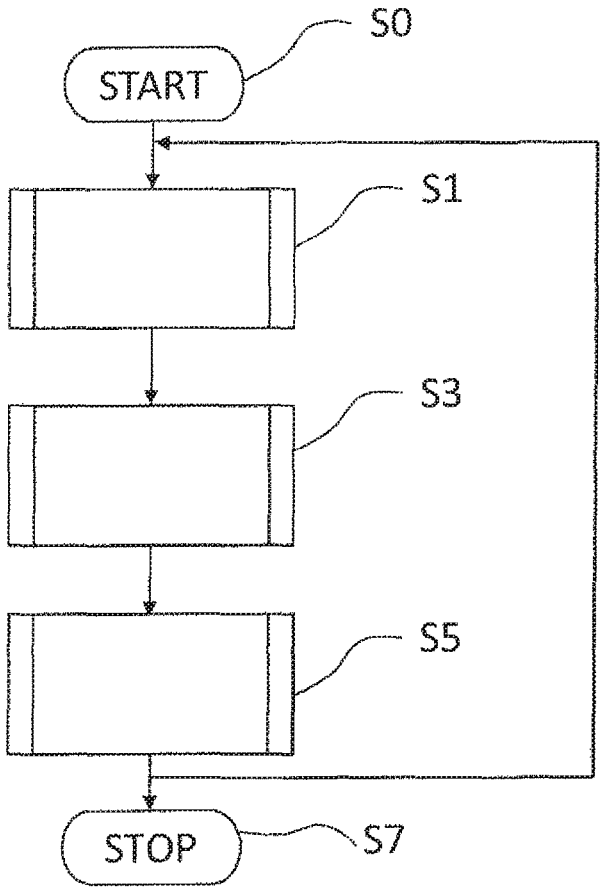

FIG. 2 shows a flow chart of the program for broadcast service following for the vehicle 30. The program can for example be executed in the receiving device 90 of the vehicle 30.

Figure 3:
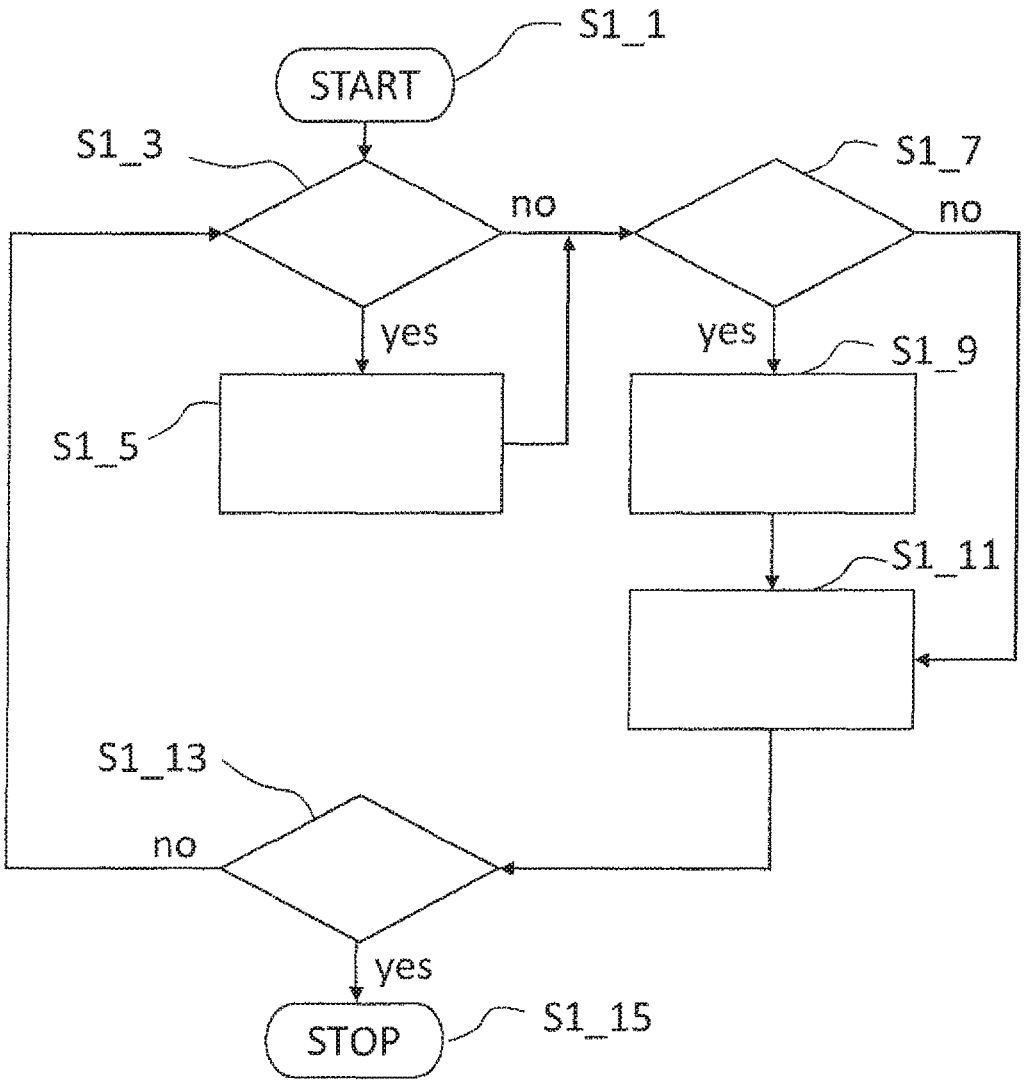
Figure 4:
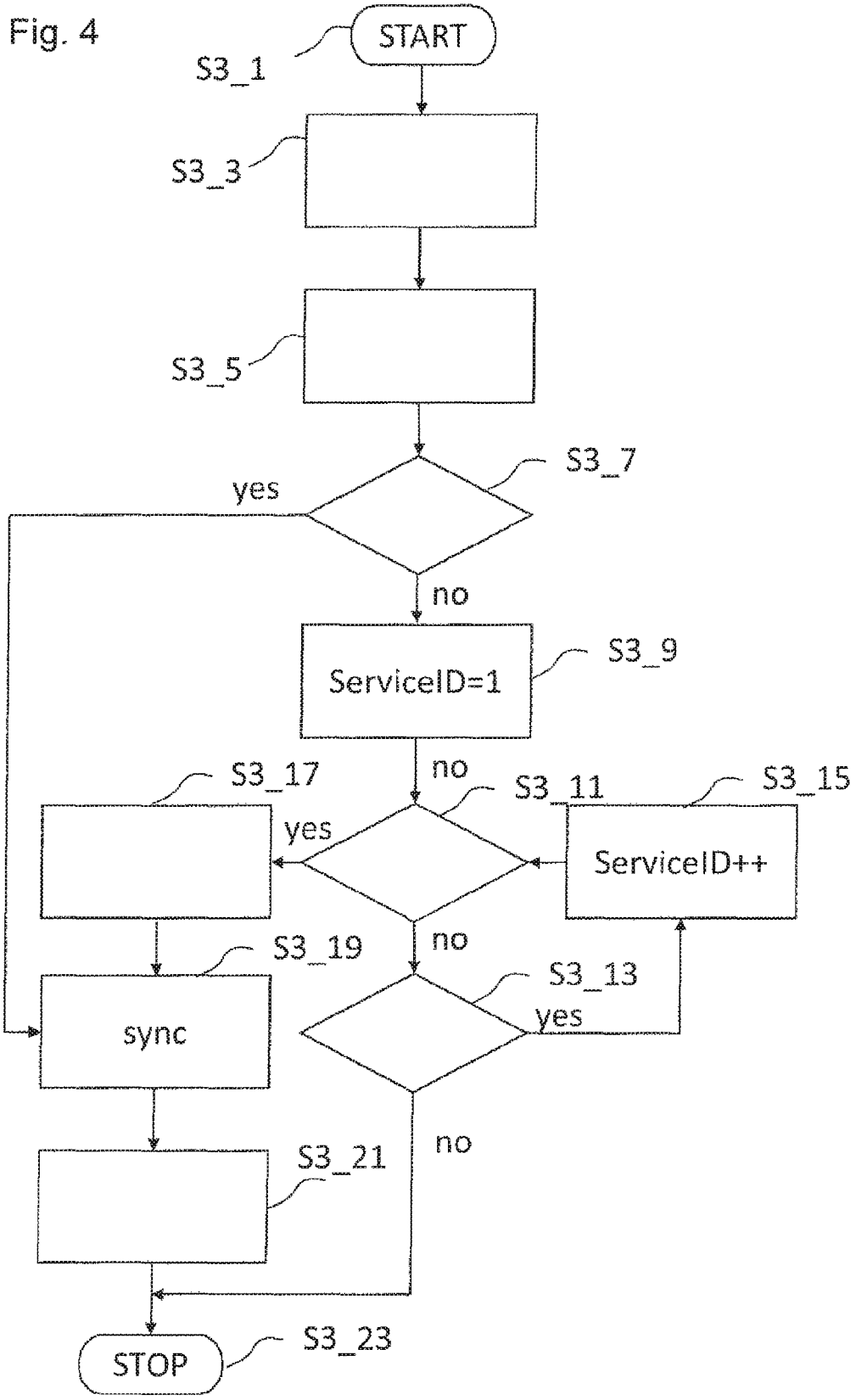
Figure 5:
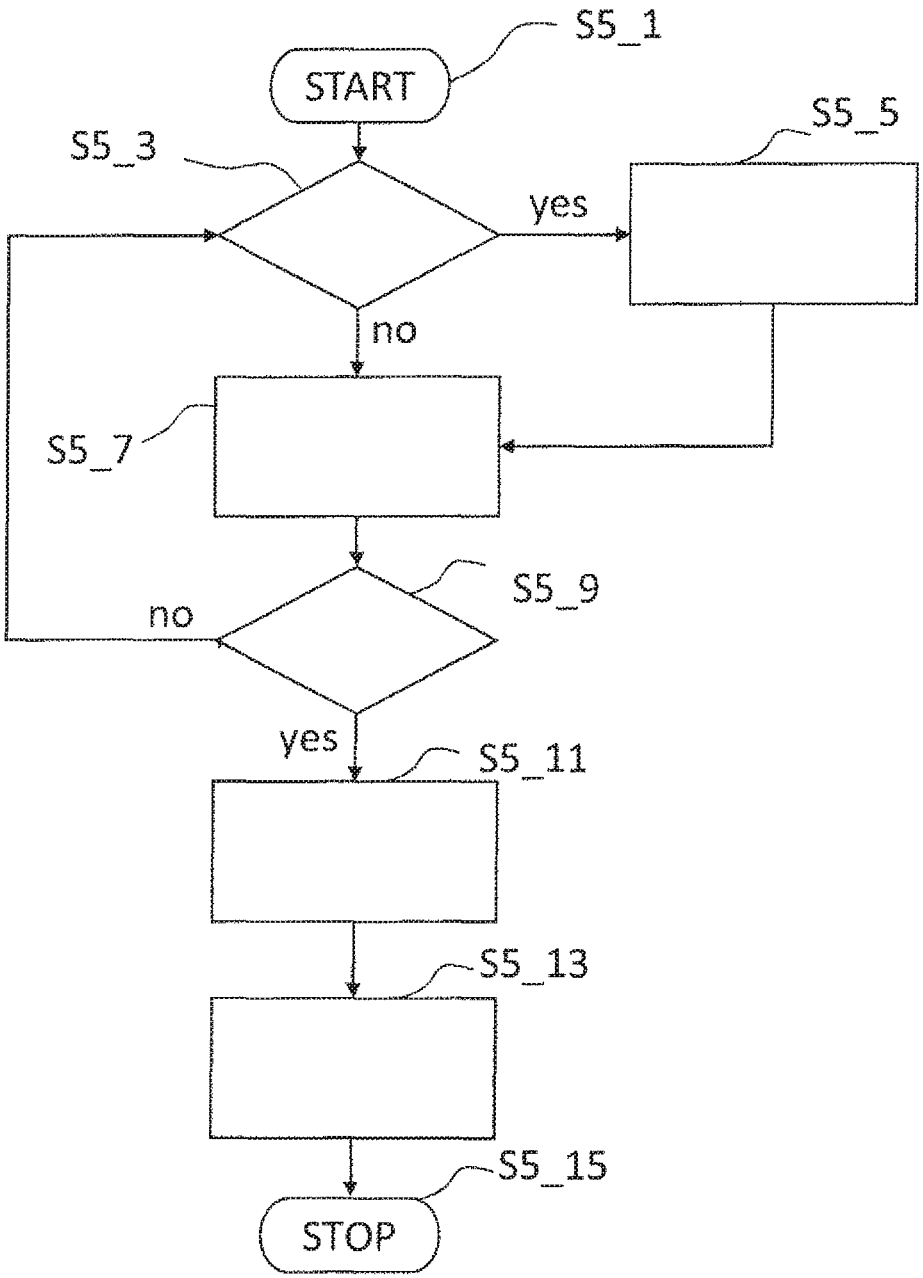

The program, for instance, comprises three sub-programs. Detailed flow charts of the sub-programs are shown in FIGS. 3 to 5. The sub-programs are, for example, executed successively. The program, for instance, is started in a step SO when an operation of the vehicle 30 is started and may be terminated in a step S7 when the operation of the vehicle 30 is terminated.

The program starts with a first sub-program S1. The first subprogram S1 serves to decide whether a handover from the DAB service to the cellular network based broadcast service has to be performed. For this purpose, continuously or in given time intervals a signal quality and/or signal availability of a signal of the DAB service and/or the cellular network based broadcast service in a route section the vehicle 30 is expected to reach in a given time span is estimated dependent on a provided data base information including data representative for geographical locations of coverage gaps of the DAB service and/or geographical locations of coverage gaps of the cellular network based broadcast service and/or transition zones of the DAB service and the cellular network based broadcast service. Additionally or alternatively the signal quality and/or signal availability of the DAB service and/or the cellular network based broadcast service in the route section the vehicle is expected to reach in the given time span is estimated dependent on a service information that is included in a received DAB signal.

An exemplary flow chart of the first sub-program S1 is shown in FIG. 3.

The first sub-program S1 starts in a step S1_1. In a step S1_3 it is checked if there is a service information included in the received DAB signal. The service information comprise, for instance, DAB coverage information.

In the case the DAB signal comprises the service information, the service information is monitored in a step S1_5. Dependent on the service information the signal quality and/or signal availability of the digital audio broadcast service signal and/or the cellular network based broadcast service signal in the route section the vehicle 30 is expected to reach in the given time span is estimated.

In DAB systems, given DAB transmission frames are used to transmit audio data and signaling information. According to DAB standard, Frequency Information (FI) of an alternative system and/or alternative frequency carrying the current tuned audio service is encoded in frames FIG 0/21 (Fast Information Group type 0 extension 21). The Frequency Information is given for different geographical regions by means of a Regional Information feature, which indicates latitude and longitude coordinates of regions where alternative frequencies of the current DAB service can be found.

A region identifier, RegionID, comprises 11 bits. "0" indicates no particular region. 2047 regions can be indicated. Some of these 2047 regions can be used, for instance, to point to DAB service coverage gaps.

With the RegionID one or more FI lists may be transmitted. The length of the FI list is indicated by a 5-bit field that expresses the length in bytes of the field containing the FI lists (max. 26 bytes). Inside each FI list the R&M (Range and Modulation, 4-bit) field indicates the broadcast system (FM, AM, DRM, etc.) by which the desired service is transmitted. According to the DAB standard, up to 9 possible R&M values to define alternative systems are still unused. For example, one of these values is used for the cellular network based broadcast services, in particular for MBMS. The IdField (16-bit) indicates the service identifier of the corresponding R&M system. Depending on the R&M field, the structure of the rest of the fields may vary to include control and/or identification fields and/or the corresponding alternative frequency values.

The FI lists (26 bytes length), for instance, may comprise the TMGI and a Flow ID corresponding to the audio services being carried by the MBMS bearer.

Additionally or alternatively, it is checked in a step S1_7 if there is a provided data base information representative for geographical locations of coverage gaps of the DAB service and/or geographical locations of coverage gaps of the cellular network based broadcast service and/or transition zones.

The data base information may be stored in a remote data base and/or in a local data base of the vehicle 30. The data base information may be used by the receiver to anticipate the handover procedure.

If data base information is available, the data base information is monitored in a step S1_9. Dependent on the data base information the signal quality and/or signal availability of the digital audio broadcast service signal and/or the cellular network based broadcast service signal in the route section the vehicle 30 is expected to reach in the given time span is estimated in the step S1_9.

The data base information may comprise the geographical locations of gaps and/or the transition zones. Table I provides some examples of the data base information contained in this data base. This information may be the same as that sent by the DAB system within the service information.

TABLE I

DAB shadow areas

| DAB ShadowID | SW Point UTM Northing | SW point UTM Easting | W perimeter | S perimeter |
|---|---|---|---|---|
| 1 | 5341222.50 | 697914.26 | 1560 | 3000 |
| 2 | 4389201.58 | 729471.20 | 2000 | 5000 |
| ... | ... | ... | ... | ... |
| ... | ... | ... | ... | ... |

Optionally, in a step S1_11, provided measurement data of the current digital audio signal is evaluated.

Dependent on the provided measurement data, the signal quality of the current digital audio broadcast service signal and/or the cellular network based broadcast service signal is estimated in the step S1_11.

Dependent on the estimates of the signal quality of the digital audio broadcast service signal and/or the cellular network based broadcast service, in step S1_13 the handover is provided, in particular it is decided whether a handover is required or not. Preferably the handover is provided dependent on a current geo-position of the vehicle 30 and/or an expected route of the vehicle 30 and/or a velocity of the vehicle 30.

In the case the handover has to be performed, the first sub program S1 is terminated in a step S1_15 and the second subprogram S3 is started.

FIG. 4 shows an exemplary flow chart of the second subprogram S3.

The second sub-program S3 controls the handover from the DAB service to the corresponding cellular network based broadcast service. The second sub-program S3 is started in a step S3_1. In a step S3_3 a connection from the receiving device 90 to, e.g., a Broadcast Multicast Service Centre, is established and in a step S3_5 a registration of the receiving device 90 is induced.

In a step S3_7 it is checked whether corresponding user service descriptors of the cellular network based broadcast service are available thanks to the data base information and/or the service information included in the received DAB signal. In the case user service descriptors of the cellular network based broadcast service are available, in a step S3_9 a synchronization between the DAB service and the cellular network based broadcast service is started dependent on a given delay. For instance, the receiving device 90 buffers the audio content by slowing down the reproduction or repeating the last seconds of the service. For instance, the cellular network based broadcast service delay with respect to the DAB is provided in the database and/or in the DAB signaling, in particular in the service information. After synchronizing, the receiving device 90 is ready to start, in a step S3_11, the reproduction of the cellular network based broadcast service.

The service information included in the DAB signal of the currently received DAB service preferably comprises or represents the user service descriptors of the cellular network based broadcast service. If the system is an eMBMS system, for instance, the Broadcast Multicast Service Center and the receiving device 90 exchange signaling messages to complete user registration. Then, for example, an MBMS User Service Discovery/Announcement starts. This process allows the receiving device 90 to obtain a list of available MBMS user services or user service bundles along with information on the user services, which enables the eMBMS user service selection.

For the service selection, several service discovery mechanisms may be used:

A user service announcement over an MBMS bearer using a download delivery function.

The user service announcement using an interactive announcement function (service descriptions to the receiving device 90 using HTTP)

Possible other user service announcement and discovery mechanisms by other means.

Alternatively or additionally, the data base information comprises the user service descriptors or representatives thereof. In the eMBMS system the data base information, for instance, comprises the TMGI and a Flow ID for each DAB service identifier for the respective DAB service transmitted through cellular network based broadcast service and required data for the synchronization. Dependent on this information, together with GPS coordinates and data from the navigation system, for instance, the transition zones needed for the service following are precalculated.

Table II provides some examples of the data base information contained in this data base.

TABLE II

| Service following information | | | | |
|---|---|---|---|---|
| DAB serviceID | DAB ShadowID | TMGI | Flow ID | Delay |
| C221 | 1 | 64 Bits | 1 | −2031 ms |
| C221 | 2 | 64 Bits | 9 | 63 ms |
| . . . | | | | |

This information is preferably the same as that of the service information.

This simplifies the handover procedure and, consequently, its latency since the receiving device 90 does not need to read all service description elements to find out the user service descriptors of the cellular network based broadcast service, as shown below.

However, if the user service descriptors of the corresponding cellular network based broadcast service are unknown, in step S3_11 (in conjunction with the loop S3_13/S3_15) the user service descriptors are, for instance, iteratively determined by evaluating cellular network based broadcast service descriptions. In this case, a service description element of the respective DAB service is included in the cellular network based broadcast service description, in particular in the Multimedia Broadcast Multicast Service User Service Description.

With regard to the eMBMS system, the receiving device 90 collects all user service bundles from eMBMS and searches iteratively for a DAB serviceID in a "bundleDescription" element, which contains one or several "userServiceDescription" elements that describe an MBMS User Service. In order to identify an MBMS User Service, each "userServiceDescription" element comprises a unique identifier, the "serviceid" attribute, and may contain one or more "name" elements. The "serviceid" is, for example, of Uniform Resource Name (URN) format.

The Uniform Resource Identifier (URI) uses a syntax "urn:"<NID>":" <NSS>, wherein <NID> is a namespace identifier, which determines a syntactic interpretation of <NSS>, the namespace specific string. The 3GPP provides a list of URN values with different NSSs which make use of the "3gpp" NID. In order to simplify the identification of the same digital audio service on both technologies, the "serviceid" attribute of an MBMS User Service description contains, for instance, the service ID used in the DAB (16 bits). For example, the NSS for a digital audio service consists of a "dab" prefix followed by the DAB serviceid (16 bits) as follows:

"urn:3gpp:dab"<DAB serviceID>

Once the corresponding MBMS User Service is found, all related user service descriptors are extracted, including the Temporary Mobile Group Identity (TMGI) and the Flow ID of the MBMS session related to this service. In this manner, the receiver has the information needed to find any given DAB service inside the eMBMS signal. In the event that the corresponding DAB service could be determined, the second program continues in the step S3_9.

Optionally, in step S3_9, geo-positions where the service following proceeded successfully are stored in the data base and/or another data base.

In the event that no user service descriptors could be determined in step s3_11 or when the reproduction of the cellular network based broadcast service is started, the second subprogram S3 is terminated in step S3_23 and the third subprogram S5 is started.

An exemplary flow chart of the third sub-program S5 is shown in FIG. 5. The third sub-program S5 aims at providing a handover form the cellular network based broadcast service to the corresponding DAB service. The third subprogram continues to check the data base information. The data base information may also comprise stored service information. The receiver device may be configured to store the respective service information, which was included in the received DAB service signal.

The third sub-program S5 starts in a step S5_1.

In a step S5_3 it is checked whether there is a provided data base information available representative for geographical locations of coverage gaps of the DAB service and/or geographical locations of coverage gaps of the cellular network based broadcast service and/or transition zones of the DAB service and the cellular network based broadcast service.

If the data base information is available, the data base information is monitored in a step S5_5. Dependent on the data base information, the signal quality and/or signal availability of the digital audio broadcast service signal and/or the cellular network based broadcast service signal in the route section the vehicle 30 is expected to reach in the given time span is estimated in step S5_5.

Optionally, in a step S5_7 provided measurement data of the current digital audio signal and/or the current cellular network based broadcast service signal is evaluated. Dependent on the provided measurement data, the signal quality of the current digital audio broadcast service signal respectively the cellular network based broadcast service signal is estimated in step S5_7.

Dependent on the estimates of the signal quality of the digital audio broadcast service signal and/or the cellular network based broadcast service signal, in step S5_9 the handover is provided, in particular it is decided whether a handover is possible or, in the case of a bad cellular network base broadcast service coverage, required.

In the case the handover is possible and/or required, in a step S5_11 the receiving device 90 establishes a connection to the DAB and the synchronization between the DAB service and the cellular network based broadcast service is started. After synchronizing, the receiving device 90 is ready to start, in a step S5_13, the reproduction of the cellular network based broadcast service.

When the reproduction of the DAB is started, the third sub-program S5 is terminated in step S5_15 and the first subprogram S1 is started again.

REFERENCE NUMERALS

10 Digital Audio Broadcast broadcasting tower
20 base station
30 vehicle
40 road
50 DAB service coverage zone
60 DAB service coverage gap
70 transition zone
80 cellular network based broadcast service coverage zone
90 receiving device S1 first sub-program
S3 second sub-program
S5 third sub-program
S1_x, processing steps
S3_x,
S5_x The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for broadcast service following for a vehicle, wherein the vehicle is configured to receive signals of a Digital Audio Broadcast, DAB, system and at least of one cellular network based broadcast system, the method comprising the acts of:

continuously, or in given time intervals, estimating a signal quality and/or signal availability of the DAB service and/or the cellular network based broadcast service in a route section the vehicle is expected to reach in a given time span dependent on a provided data base information comprising data representative for geographical locations of coverage gaps of the DAB service and/or geographical locations of coverage gaps of the cellular network based broadcast service and/or transition zones of the DAB service and the cellular network based broadcast service, and/or a service information, which is included in a received DAB signal, comprising data representative for geographical locations of coverage gaps of the DAB service and/or geographical locations of coverage gaps of the cellular network based broadcast service and/or transition zones of the DAB service and the cellular network based broadcast service; and performing a handover from the DAB service to the corresponding cellular network based broadcast service dependent on the estimated signal quality and/or signal availability.

2. The method according to claim 1, wherein continuously, or in given time intervals, the signal quality and/or the signal availability of the DAB service and/or the cellular network based broadcast service in the route section the vehicle is expected to reach in the given time span is estimated dependent on provided measurement data of a current digital audio broadcast service signal respectively a current cellular network based broadcast service signal received by the vehicle.

3. The method according to claim 2, wherein the cellular network based broadcast service comprises an Enhanced Multimedia Broadcast Multicast Service, eMBMS.

4. The method according to claim 3, wherein the handover is provided dependent on a current geo-position of the vehicle and/or an expected route of the vehicle and/or a velocity of the vehicle.

5. The method according to claim 4, wherein, in the case the handover is performed, the cellular network based broadcast service, which corresponds to the DAB service, is determined dependent on a DAB service ID information carried within user service descriptors contained in a cellular network based broadcast service signal.

6. The method according to claim 5, wherein the service information included in the received DAB signal comprises or represents the user service descriptors of the cellular network based broadcast service.

7. The method according to claim 6, wherein the user service descriptors of the cellular network based broadcast service corresponding to the respective DAB service are retrieved from a given data base.

8. The method according to claim 7, wherein the DAB service ID information of the respective DAB services is included in a Multimedia Broadcast Multicast Service User Service Description, such that the DAB service ID, which identifies the DAB service, is included in a Uniform Resource Name, URN, of the Enhanced Multimedia Broadcast Multicast Service, and all or nearly all user service bundles from Enhanced Multimedia Broadcast Multicast Service are collected and are searched iteratively for the DAB service ID to find the corresponding cellular network based broadcast service.

9. The method according to claim 8, wherein a synchronization between the DAB service and the cellular network based broadcast service is performed by buffering an audio content of the DAB service and/or the cellular network based broadcast service dependent on a given delay between the DAB service and the cellular network based broadcast service, wherein the delay is provided by the data base and/or the service information included in the received DAB signal.

10. The method according to claim 9, wherein geopositions, where the service following proceeded success-fully are stored in the data base and/or another data base to be usable as the data base information.

11. A method for broadcast service following for a vehicle, wherein the vehicle is configured to receive signals of a Digital Audio Broadcast, DAB, system and at least of one cellular network based broadcast system, the method comprising the acts of:

continuously, or in given time intervals, estimating a signal quality and/or signal availability of the DAB service and/or the cellular network based broadcast service in a route section the vehicle is expected to reach in a given time span dependent on a provided data base information comprising data representative for geographical locations of coverage gaps of the DAB service and/or geographical locations of coverage gaps of the cellular network based broadcast service and/or transition zones of the DAB service and the cellular network based broadcast service; and performing a handover from the cellular network based broadcast service to the corresponding DAB service dependent on the estimated signal quality and/or signal availability.

12. An apparatus for broadcast service following for a vehicle, wherein the apparatus is configured to execute the method according to claim 11.

* * * * *